United States Patent [19]

Ueno et al.

[11] Patent Number: 4,815,430

[45] Date of Patent: Mar. 28, 1989

[54] PORTABLE ENGINE UNIT

[75] Inventors: Tetsuo Ueno, Tokyo; Katsumi Kiyooka, Saitama, both of Japan

[73] Assignee: Komatsu Zenoah Company, Higashiyamato, Japan

[21] Appl. No.: 131,726

[22] Filed: Dec. 11, 1987

Related U.S. Application Data

[62] Division of Ser. No. 844,539, Mar. 26, 1986, abandoned.

[51] Int. Cl.[4] ..... F02B 63/00

[52] U.S. Cl. ..... 123/195 R; 123/198 E

[58] Field of Search ..... 123/2, 195 R, 198 E

[56] References Cited

U.S. PATENT DOCUMENTS 4,343,271 8/1982 Skatsche et al. ..... 123/195 R 4,377,993 3/1983 List ..... 123/195 R

*Primary Examiner*—E. Rollins Cross

*Attorney, Agent, or Firm*—Wolf, Greenfield & Sacks

[57] ABSTRACT

A portable engine unit is provided. The unit comprises an engine including a clutch, a crankcase enclosing a crank shaft, an engine cylinder enclosing a piston and a piston rod, a carburetor, an air filter, a recoil starter, and a muffler; and a housing for enclosing the engine, comprising at least two portions which are assembled and disassembled along a plane including the axis of rotation of an output shaft of the engine to enclose and expose the engine.

6 Claims, 14 Drawing Sheets

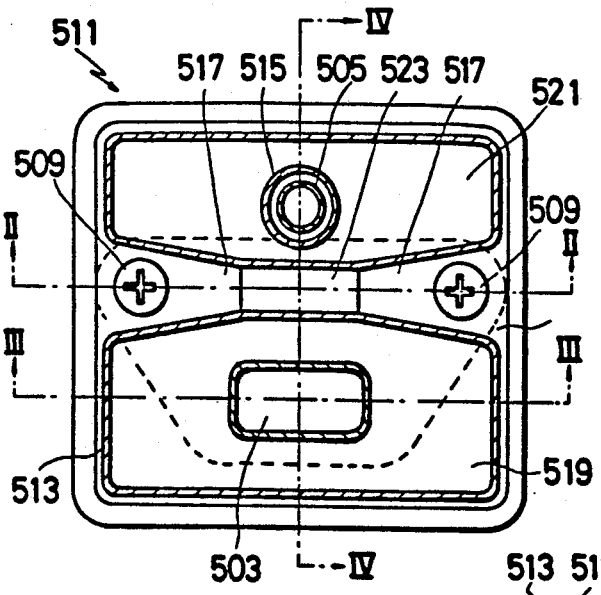
FIG.25
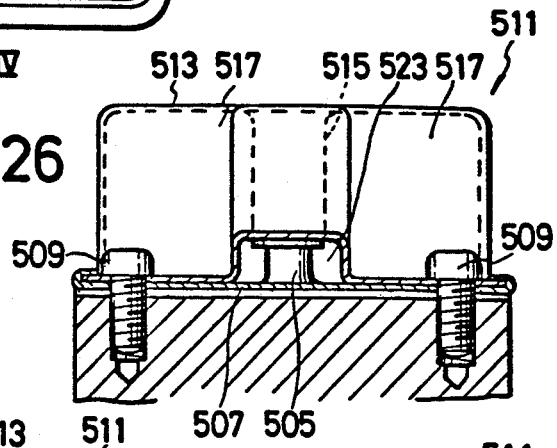
FIG.26
FIG.27
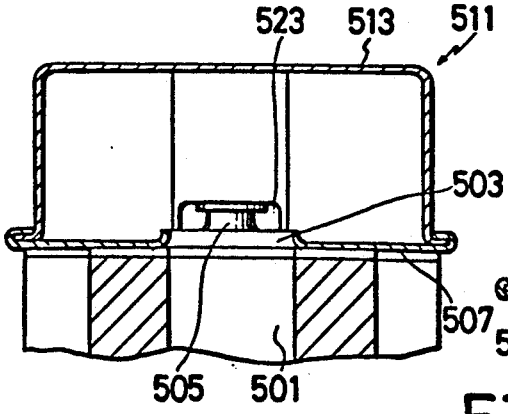
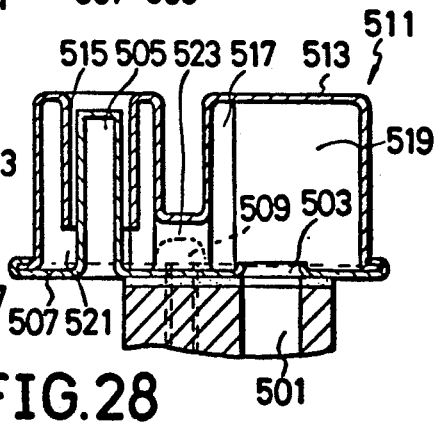
FIG.28

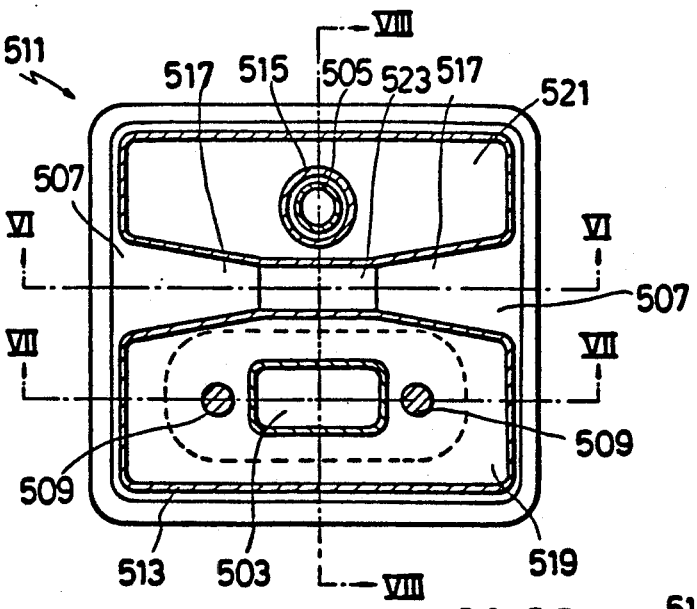
FIG. 29
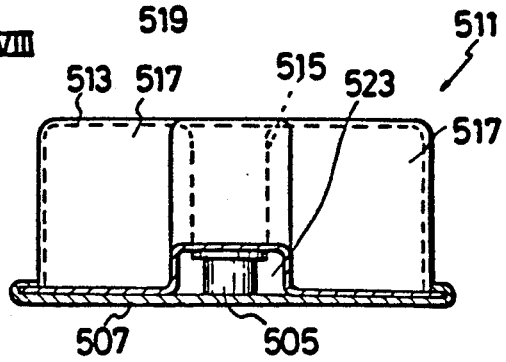
FIG.30
FIG.31
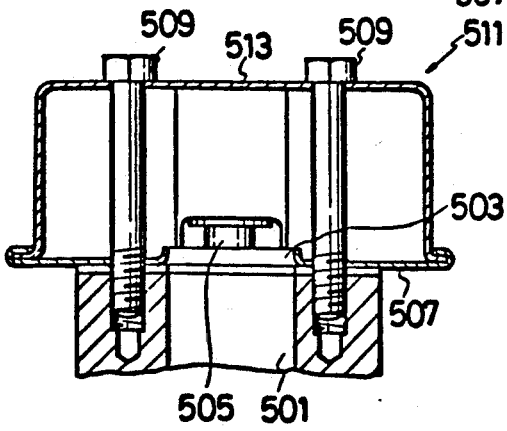
FIG.32
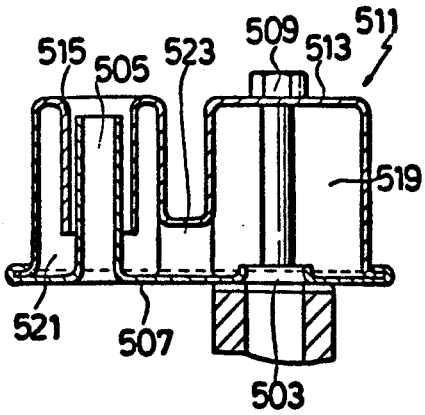

PORTABLE ENGINE UNIT

This application is a division of application Ser. No. 844,539, filed Mar. 26, 1986 now abandoned.

BACKGROUND OF THE INVENTION

1. Field of the Invention

The present invention relates to a portable engine unit, and more particularly to a portable engine unit applicable for a weed cutter, snow blower, etc., and has a housing which is separated along a plane including the axis of rotation of an output shaft of the engine.

2. Description of the Prior Art

In a prior art portable engine unit, a housing which encloses an engine is divided along a plane orthogonal to the axis of rotation of an output shaft of the engine and provided with two cover casings which are fitted to the opposite sides of the housing. Further, in many prior art portable engine units, separate casings shall be provided for enclosing a cylinder, muffler, etc., of the engine. As a result, the number of parts are increased to complicate the processing and assembling works of engine.

A prior art portable weed cutter, etc., which comprises a portable engine unit and a cutter is provided with a handle which is usually fixed to a connection pipe for connecting the engine with the cutter. This location of the handle tends to cause a problem that the whole length of the weed cutter becomes longer.

Measures to cope with noise and vibration are not sufficiently realized in a prior art portable engine unit. For instance, in some prior art portable engines, suction holes are provided on a side face of a housing of engine to cause a large suction noise. In the vicinity of the suction holes, an air filter is usually disposed in a separate air filter case which occupies a relatively large space in the housing to limit the size of air filter that again leads to a large suction noise. To reduce exhaust noise, a muffler is provided. A prior art muffler provided for a portable engine is usually welded to the engine that complicates the manufacturing process and the maintenance work of muffler. Further, the high temperature of exhaust gas is not sufficiently cooled by the prior art muffler so that an operator may get burnt and the engine may be damaged due to the high temperature of exhaust gas. A spark arrestor for catching fire in exhaust gas is attached between the base of prior art muffler and an exhaust port of the engine. This location of spark arrestor causes a maintenance work such as cleaning of the spark arrestor to be difficult.

Concerning to vibration, a prior art portable engine is provided with a plurality of vibration isolators between the engine and a housing of the engine. The engine comprises a crankcase enclosing a cantilever crank arm, a recoil starter, a magnet wheel, and a centrifugal clutch comprising a clutch drum and a clutch shoe member. These components are arranged axially in series to constitute the engine. The vibration isolators are positioned around the engine gravity center which is usually located in front of the crankcase. In this arrangement, the gravity center of reciprocating parts such as a piston and a piston rod, which are main factors of vibration, are positioned out of an area surrounded by the vibration isolators. As a result, vibration is not effectively prevented.

As another measure to cope with vibration, the prior art portable engine is equipped with a vibration isolator joint between the centrifugal clutch and a torque transmission shaft which transmits torque generated by the engine through the clutch to a work tool such as a weed cutter. In order to house the vibration isolator joint and the clutch drum, a special casing is required that increases the manufacturing process and cost as well as the weight of engine.

For cooling the engine, the prior art portable engine is provided with a fan which is fixed to a crank shaft of the engine, and a spiral passage for guiding airflow generated by the fan to the periphery of engine. Due to the spiral configuration of the airflow passage, the overall size and weight of the engine tend to become large.

SUMMARY OF THE INVENTION

An object of the present invention is to provide a portable engine unit with a housing which comprises at least two portions assembled and disassembled along a plane including the axis of rotation of an output shaft of the engine, thereby reducing the manufacturing and assembling process and the cost.

Another object of the present invention is to provide a portable engine unit with a housing equipped with a front handle, a rear handle, and a hook for shoulder band which serve to easy handling of the engine.

A third object of the present invention is to provide a portable engine unit, in which a large air filter is supported directly by a housing of the engine, and a suction air passage is defined within a rear handle which is formed solidly with the housing to perform air cleaning and noise reducing functions effectively.

A fourth object of the present invention is to provide a portable engine unit equipped with a muffler which can reduce the noise and temperature of exhaust gas effectively, in which a spark arrestor fitted to the muffler is easy to clean. The muffler can be fixed to the engine with bolts but not with welding.

The fifth object of the present invention is to provide a portable engine unit having vibration isolators which are located to surround an area in which a gravity center of reciprocating parts such as a piston and a piston rod of the engine moves, thereby reducing the vibration of engine effectively.

The sixth object of the present invention is to provide a portable engine unit having a vibration isolator joint fitted directly to a clutch drum of the engine to transmit the torque of engine to a work tool such as a weed cutter.

The seventh object of the present invention is to provide a portable engine unit in which a clutch drum is fixed to a crank shaft without a clutch casing.

The other object of the present invention is to provide a portable engine unit equipped with a fan, a baffle, and a guide plate, in which an engine cylinder is effectively cooled by airflow generated by the fan and guided by the baffle an the guide plate.

BRIEF DESCRIPTION OF THE DRAWINGS

These and other objects, features and advantages of the present invention will become apparent from the following descriptions of preferred embodiments taken in conjunction with the accompanying drawings in which:

FIGS. 25 to 28 are views showing a muffler according to still another embodiment of the present invention;

FIGS. 29 to 32 are views showing a muffler according to still another embodiment of the present invention;

DETAILED DESCRIPTION OF THE EMBODIMENTS

Embodiments of the present invention will now be described with reference to accompanying drawings in which the present invention is applied for a weed cutter.

Figure 1:
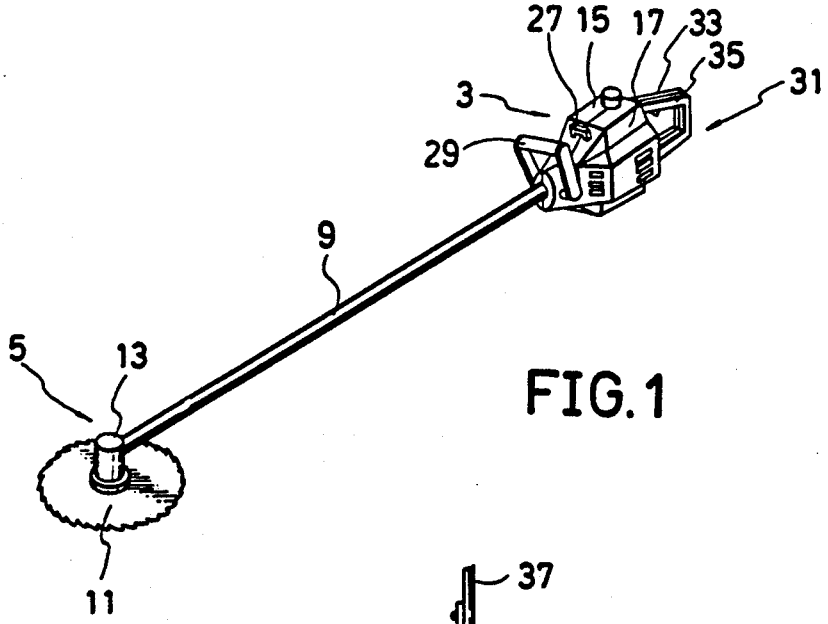
FIG. 1 is a perspective view showing a weed cutter to which an engine unit according to the present invention is applied.
Figure 2:
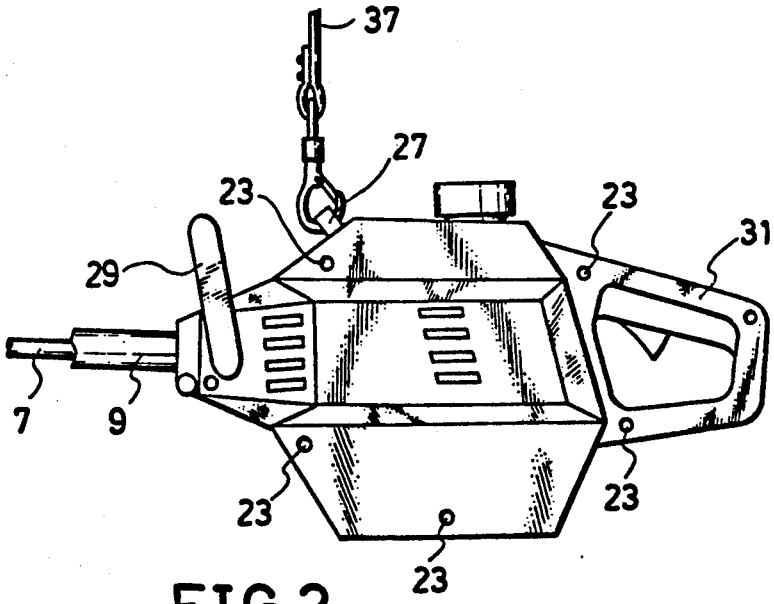
FIG. 2 is a side view showing an engine housing of the weed cutter shown in FIG. 1.
Figure 3:
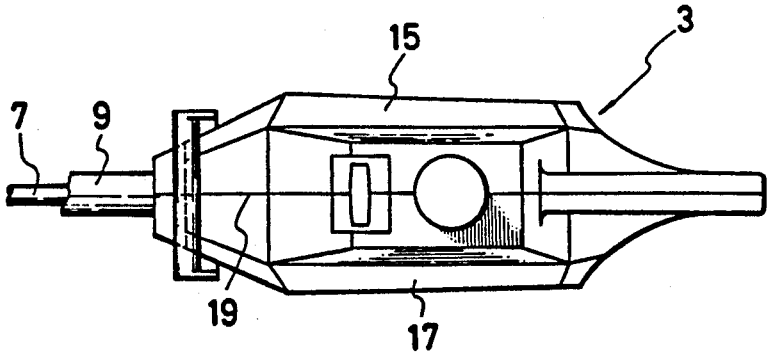
FIG. 3 is a plan view showing the engine housing.

FIGS. 1 to 3 show the external view of the weed cutter. An engine 1 (FIG. 4) is enclosed in a housing 3 which is connected with a weed cutter 5 through a transmission shaft 7 disposed in a connection pipe 9. The weed cutter 5 comprises a rotary blade 11 and a bearing member 13 which supports the rotary blade 11 and incorporates bevel gears (not shown) to transmit torque from the transmission shaft 7 to the rotary blade 11. The housing 3 is made of synthetic resin and divided into a right housing 15 and a left housing 17 along a boundary plane 19 which includes the axis of rotation of an output shaft (a crank shaft) 21 of the engine 1. The right and left housings 15 and 17 are fitted together with screws 23. A fuel tank 25 (FIG. 4) is provided at an upper part inside the housing 3. The housing 3 is also provided with a hook 27, a front handle 29, and a rear handle 31 comprising a right portion 33 and a left portion 35, all of which will be described later. In FIG. 2, a shoulder band 37 is hooked to the hook 27.

Since the housing 3 is separated into the right and left housings 15 and 17 along the plane 19 including the axis of rotation of crank shaft 21, the engine 1, fuel tank 25, etc., are fixed easily between the right and left housings 15 and 17. The number of components which constitute the housing 3 is only two (right and left housings 15 and 17) which is smaller in comparison with a prior art housing so that the engine unit according to the present invention may reduce the manufacturing and assembling process as well as cost.

Figure 4:
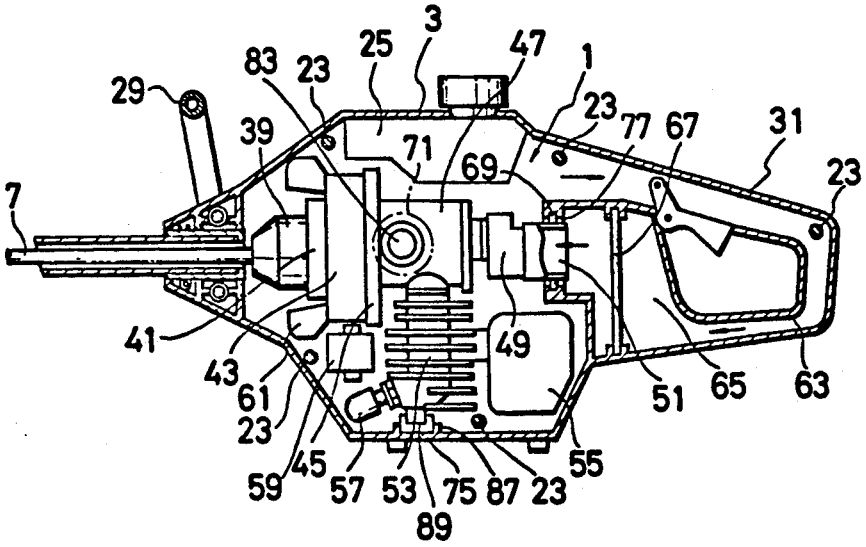
FIG. 4 is a view showing the cross section of the engine housing with an engine being exposed.

FIG. 4 shows the arrangement of engine 1, in which a vibration isolator joint 39, a clutch drum 41, a magnet wheel 43, a recoil starter 45, a crankcase 47, a carburetor 49, and a choke case 51 are disposed axially in series. The vibration isolator joint 39 is connected with the transmission shaft 7. An engine cylinder 53 is connected to the bottom of crankcase 47. A muffler 55 is connected to the rear of cylinder 53. An ignition plug 57 is attached to the cylinder 53 and actuated by an ignition coil 59 which is located in the vicinity of the circumference of magnet wheel 43 and generates electric power in response to magnets (not shown) embedded in the periphery of magnet wheel 43. The magnet wheel 43 is provided with a plurality of fins 61 for generating airflow. The torque of engine 1 is transmitted to the rotary blade 11 via the transmission shaft 7. An operator grips with his hands the front and rear handles 29 and 31 and cuts weeds with the rotary blade 11.

As shown in FIG. 4, the rear handle 31 is hollow, and the hollow portion forms a suction passage 63. An upper end of the passage 63 is open to the engine 1 to receive airflow generated by the fins 61. An lower end of the passage 63 communicates with a suction chamber 65. An air filter 67 is disposed to cross the suction chamber 65. Due to this, airflow generated by the fins 61 enters into the upper end of passage 63 and into the chamber 65, passes through the air filter 67, and is sucked into the carburetor 49. A suction noise generated by the carburetor 49 is reduced during its propagation through the long passage 63 toward the fins 61 side.

Figure 6:
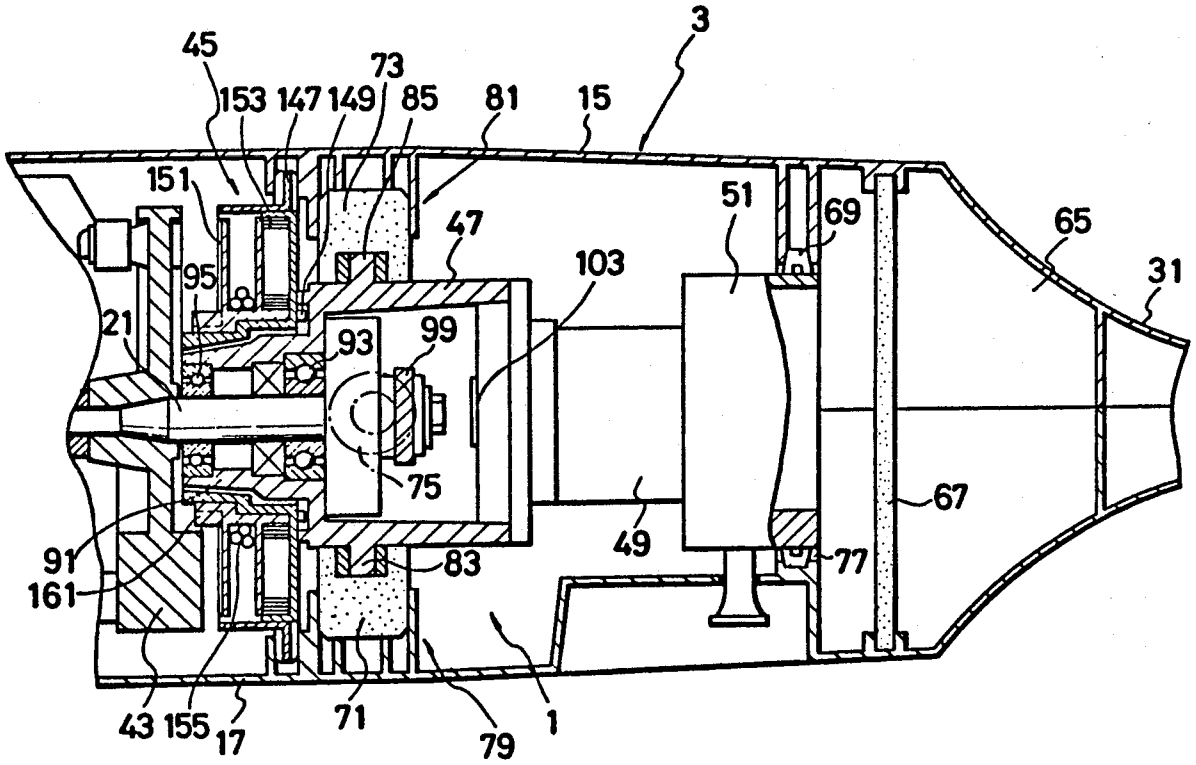
FIG. 6 is a cross-sectional plan view showing the essential part of the housing and engine.

As shown in FIG. 4 and also in FIG. 6, the periphery of air filter 67 is entirely held by the inner side of housing 3. According to this arrangement, a separate casing for the air filter 67 is not required so that the constitution inside the housing 3 may become simpler, and the size of air filter 67 may be allowed to be larger.

As shown in FIGS. 4 and 6, the engine 1 is supported by the housing 3 through vibration isolators 69, 71, 73, and 75. The rubber vibration isolator 69 is sealingly disposed between the periphery of choke case 51 and an inner wall of an opening 77 located at the front end of suction chamber 65. The rubber vibration isolators 71 and 73 are received in receiver portions 79 and 81 formed on the inner surface of the casing 3. The vibration isolators 71 and 73 receive projections 83 and 85 formed on the surface of crankcase 47. The rubber vibration isolator 75 is received in a receiver portion 87 formed on the inner surface of the casing 3. The vibration isolator 83 receives in turn a projection 89 formed on the bottom surface of cylinder 53.

Figure 5:
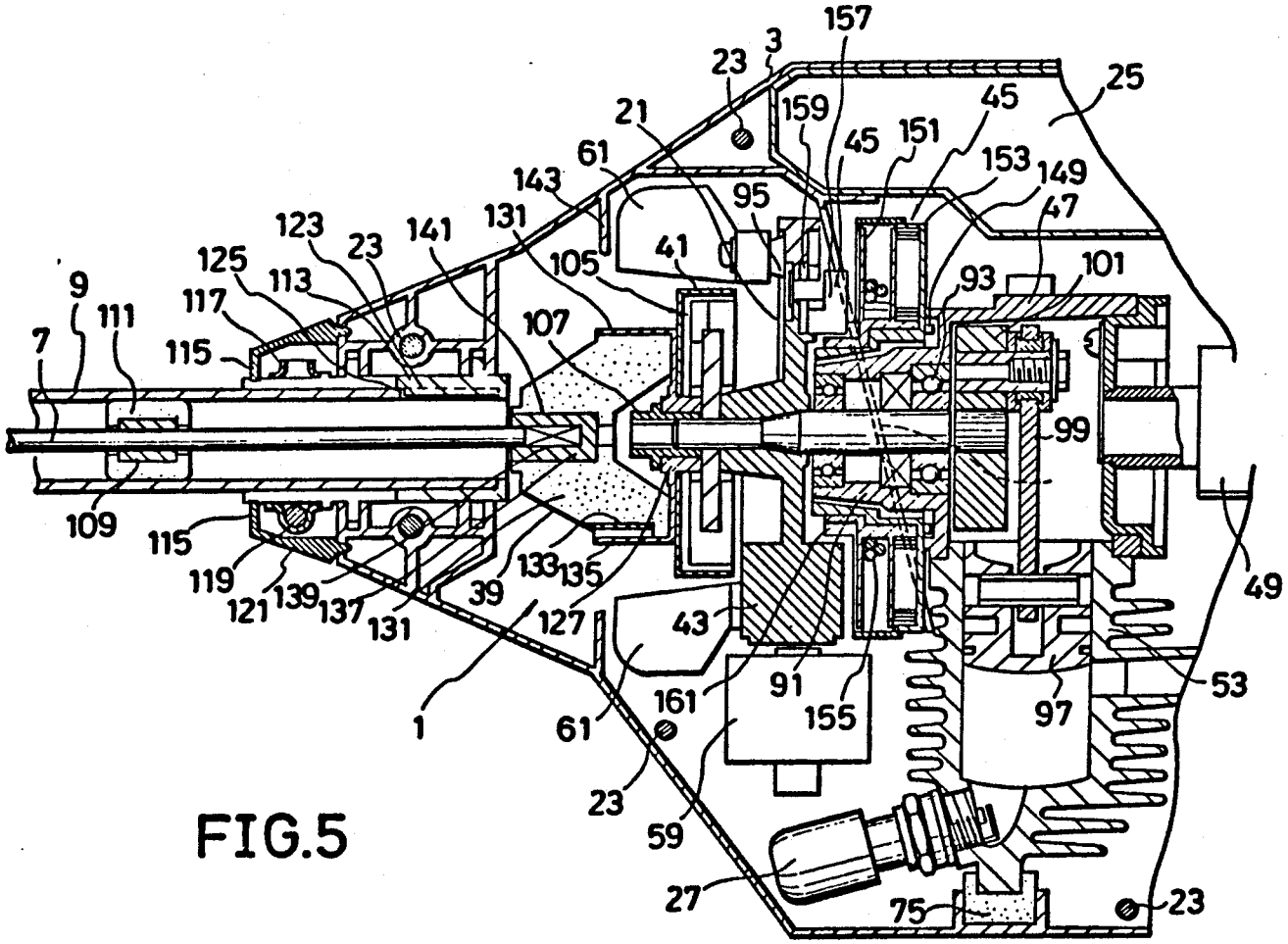
FIG. 5 is an enlarged cross-sectional side view showing the essential part of the housing and engine.

FIG. 5 shows further detail of the arrangement of engine 1. The crankcase 47 has a bearing portion 91 which supports the crank shaft 21 through bearings 93 and 95. A piston 97 is slidably enclosed in the cylinder 53 and connected through a piston rod 99 to a crank arm 101 which is fixed to the rear end of crank shaft 21. The carburetor 49 is connected to the rear of crankcase 47 through a reed valve 103 (FIG. 6). A centrifugal clutch 105 is disposed inside the clutch drum 41. Clutch shoes of the clutch 105 contact with the inner circumference of clutch drum 41 by centrifugal force applied on the clutch shoes due to the rotation of clutch 105. The clutch drum 41 may be made by synthetic resin, and may have a metallic friction ring fixed to the inner circumference thereof to contact with the clutch shoes of clutch 105. The clutch drum 41, centrifugal clutch 105, and magnet wheel 43 are fixed to the outer end of crank shaft 21 with a female screw cylinder 107. The transmission shaft 7 is supported inside the connection pipe 9 through a bearing 109 and a vibration isolator 111. A support cylinder 113 is held by the casing 3 at an front end thereof. One end of the connection pipe 9 is inserted into the support cylinder 113. The support cylinder 113 is provided with a notch 115 across which a fitting 117 is fixed. The fitting 117 is fastened by a bolt 119 to fix the connection pipe 9. A cap 121 is fitted such that it covers the fitting 117. The support cylinder 113 is provided with a projection 123 which engages with a notch 125 provided at the end of connection pipe 9 to prevent the rotation thereof.

The vibration isolator joint 39 which is one of features of the present invention will now be described with reference to FIG. 5. A boss 127 of the clutch drum 41 engages with the female screw cylinder 107 such that the clutch drum 41 is freely rotatable around the screw cylinder 107. An annular member 131 is fixed to the clutch drum 41 of the centrifugal clutch 105. A vibration isolator 131 made of resilient material such as rubber is engaged removably into the annular member 131. A recess 133 formed on the periphery of vibration isolator 131 engages with a projection 135 formed on the inner surface of the annular member 129 to prevent the relative rotation between them. A metallic fitting cylinder 137 is fixed to the center of the vibration isolator 131. The fitting cylinder 137 is provided with a hole 139 having a rectangular cross section to receive a rectangular portion 141 located at one end of the transmission shaft 7.

According to the above arrangement, the torque of engine 1 is transmitted to the transmission shaft 7 through the centrifugal clutch 105, the clutch drum 41, and the vibration isolator joint 39 without propagating the vibration of engine to the transmission shaft 7 and connection pipe 9.

FIG. 5 shows another feature of the present invention, in which an annular baffle 143 is fixed to the casing 3 to cover the front sides of the fins 61. The annular baffle 143 guides effectively airflow generated by the fins 61 toward the engine 1. There is further provided a guide plate 145 which is fixed to the housing 3 and extends in a space between the engine 1 and the housing 3 to separate the space. The guide plate 145 guides the airflow generated by the fins 61 effectively around the cylinder 53 to cool it. The annular baffle 143 may be fixed directly to the peripheries of the fins 61 instead of housing 3 such that it covers the front sides of the fins 61. According to the above arrangement, a part of airflow which tends to flow forward, hits the baffle 143 and is changed its flow direction to the engine 1 side and guided by the guide plate 145 to flow around the cylinder 53.

The recoil starter 45 will now, be described with reference to FIGS. 5 and 6. The recoil starter 45 is arranged around the bearing portion 91 with a proper gap between them. The recoil starter 45 has on its periphery a fitting portion 147 which engages with the housing 3 as well as having on its inner side face projections 149 which engage with the crankcase 47 to prevent the rotation of recoil starter 45. A reel 151 of the recoil starter 45 is rotated against the spring force of a spiral spring 153 by pulling a starter handle (not shown) fixed to an end of a starter string 155 which is wound around the reel 151. A pivotable nail 157 is arranged on the inner surface of the magnet wheel 43 and pushed by a spring 159 against a ratchet 161 provided on the outer surface of the reel 151. The reel 151 and the spiral spring 153 may solidly be made by synthetic resin.

According to the above arrangement, if the starter handle (not shown) is pulled to pull the starter string 155, the reel 151 is rotated to engage the ratchet 161 with the nail portion 157 to rotate the magnet wheel 43. Accordingly, the crank shaft 21 which is fixed to the magnet wheel 43 is rotated to start the engine 1. After that, the nail portion 157 is pushed away by the ratchet 161 to release the engagement between them, and this released state is maintained due to the centrifugal force. If the speed of engine 1 is increased to a predetermined value, the centrifugal clutch 105 is engaged with the clutch drum 41 to transmit torque to the transmission shaft 7 via the vibration isolator joint 39. Since a gap is provided between the bearing portion 91 of crankcase 47 and the recoil starter 45, the heat and vibration of crankcase 47 is not transferred to the recoil starter 45.

Figure 7:
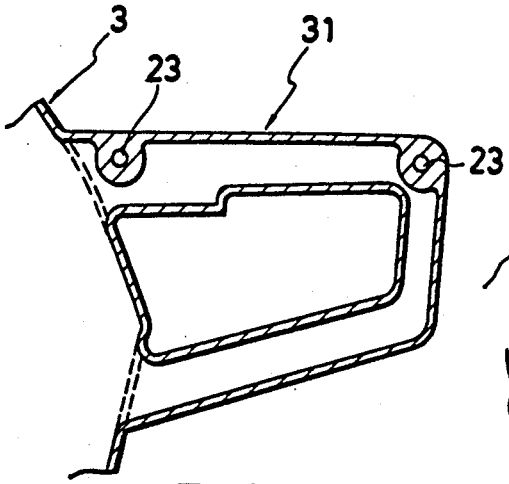
FIG. 7 is a side view showing a rear handle formed solidly with the housing.
Figure 8:
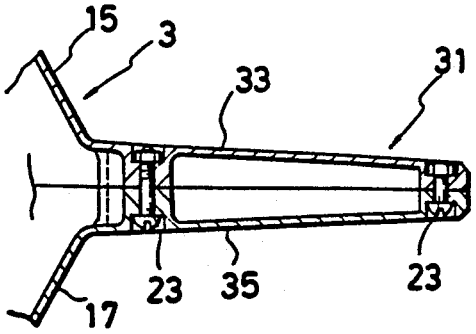
FIG. 8 is a cross-sectional plan view showing the rear handle.

FIGS. 7 and 8 show the detail of rear handle 31. A right half 33 of the rear handle 31 is formed solidly with the right housing 15, and a left half 35 with the left housing 17. The right and left halves 33 and 35 are fastened together with screws 23 when the right and left housings 15 and 17 are assembled to form the housing 3.

Figure 9:
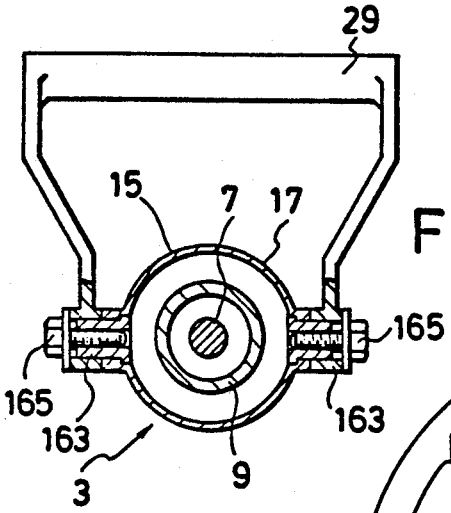
FIG. 9 is a front view partly broken showing a front handle fitted to the housing.

FIG. 9 shows the front handle 29 in detail. Shafts 163 for the front handle 29 are embedded in the right and left housings 15 and 17 respectively. The front handle 29 is pivotably fixed to the shafts 53 with bolts 165.

Figure 10:
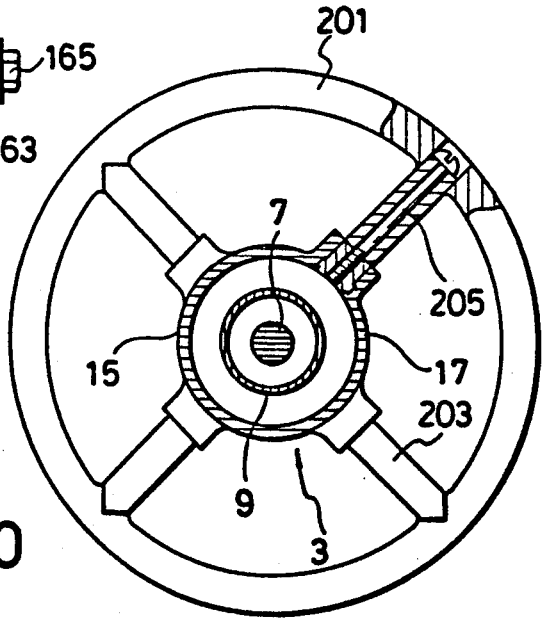
FIG. 10 is a front view partly broken showing a modification of the front handle fitted to the housing.

FIG. 10 shows a modification of front handle. A modified circular front handle 201 with radial support rods 203 is connected to the housing 3 with a screw 205. The handle 201 may be formed in a rectangular shape. The front handle 29 or 201 may help an operator in handling the weed cutter 5 by virtue of its pivotal movement or its circular or rectangular shape.

Figure 11:
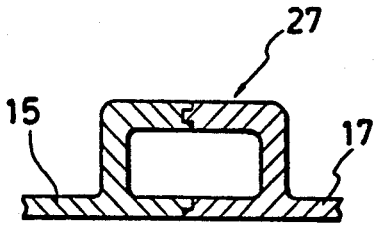
FIG. 11 is a cross-sectional side view showing a hook formed solidly with the housing for hooking a shoulder band.
Figure 12:
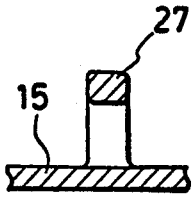
FIG. 12 is a cross-sectional front view showing the hook shown in FIG. 11.
Figure 13:
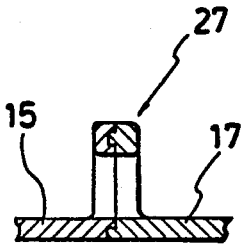
FIG. 13 is a cross-sectional side view showing a modification of the hook formed solidly with the housing for hooking a shoulder band.
Figure 14:
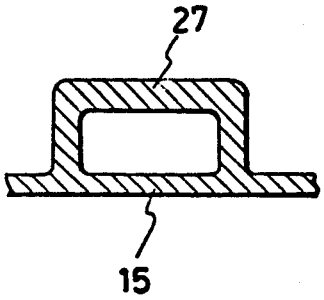
FIG. 14 is a cross-sectional front view showing the hook shown in FIG. 13.

FIGS. 11 to 14 show the hook 27 in detail. The hook 27 is disposed at a front portion of the housing 3, and a shoulder band 37 is hooked to the hook 27. In FIGS. 11 and 12, the hook 27 is laterally divided into two portions which are solidly formed on the right and left housings 15 and 17 respectively, while, in FIGS. 13 and 14, the hook 27 is longitudinally divided into two portions which are solidly formed on the right and left housings 15 and 17 respectively.

Figure 15:
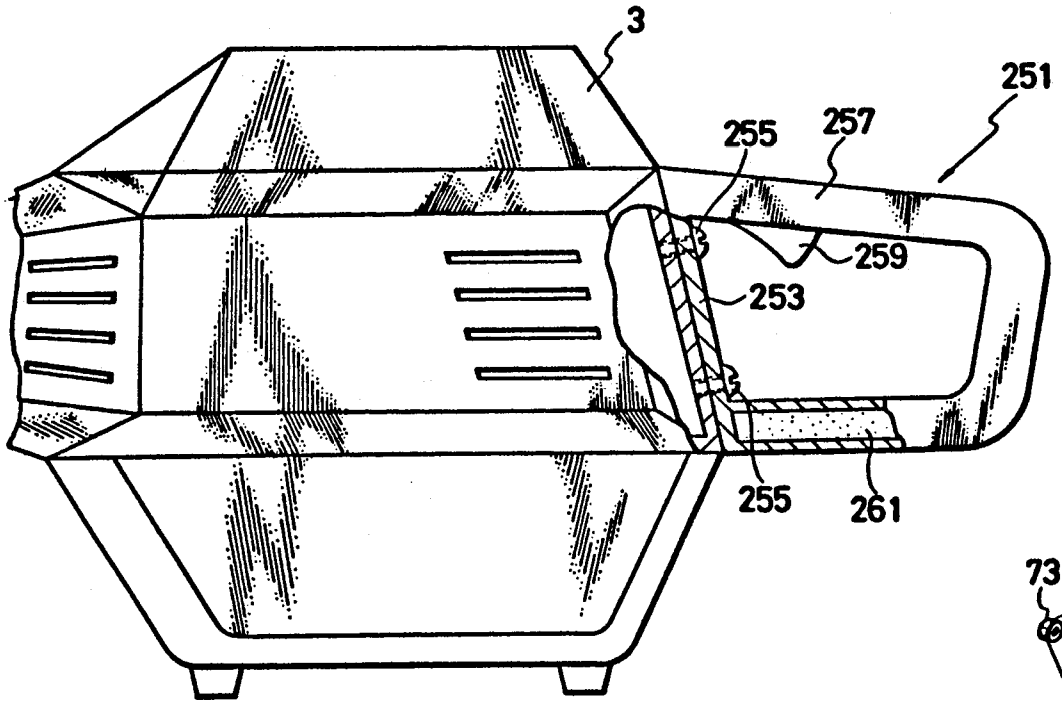
FIG. 15 is a side view partly broken showing another example of rear handle which is fitted to the housing with bolts.
Figure 17:
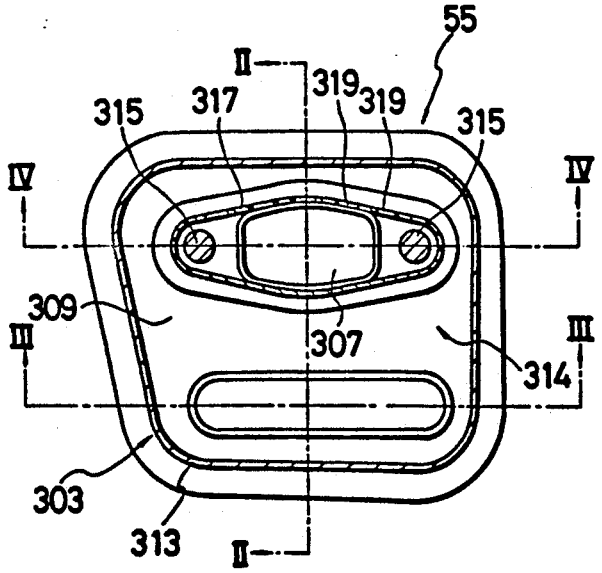
FIGS. 17 to 20 are views showing a muffler according to an embodiment of the present invention.
Figure 18:
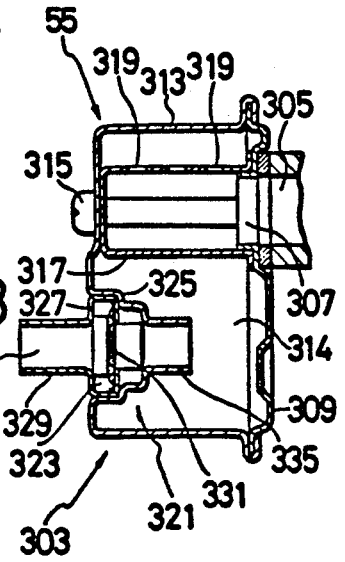
Figure 19:
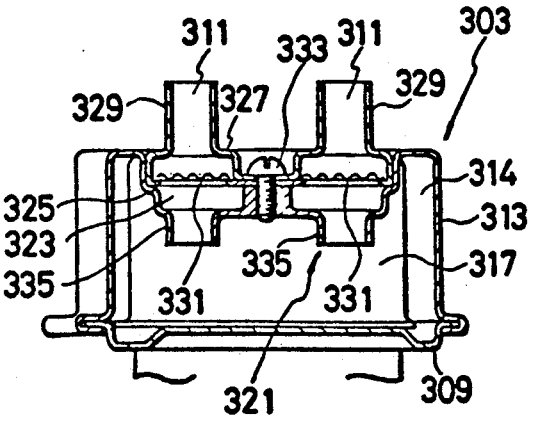
Figure 20:
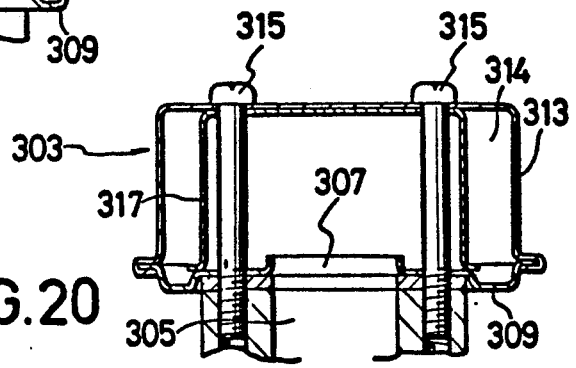
Figure 21:
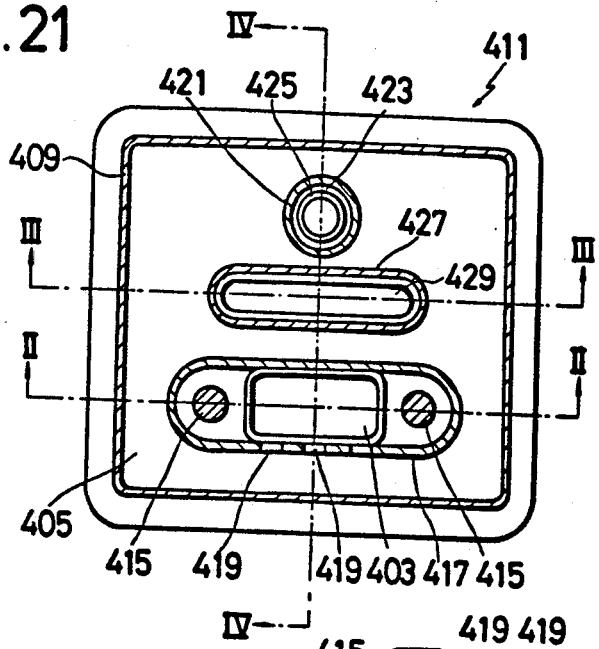
FIGS. 21 to 24 are views showing a muffler according to another embodiment of the present invention.
Figure 22:
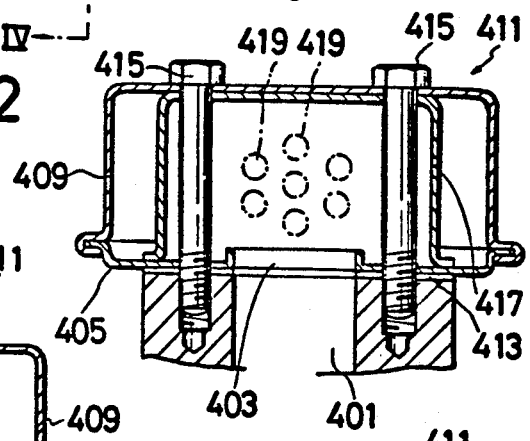
Figure 23:
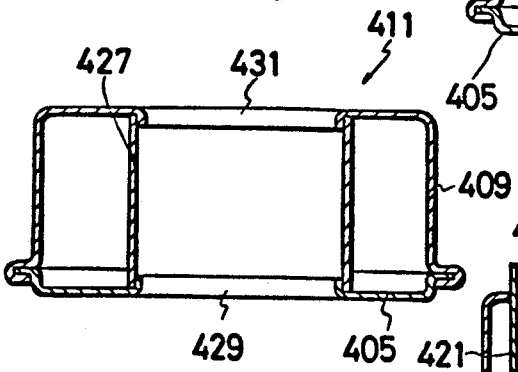
Figure 24:
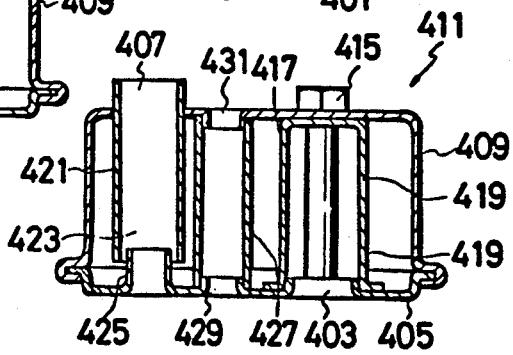

FIG. 15 shows a modification of rear handle. A modified rear handle 251 comprises a flange portion 253 which is removably fixed to the housing 3 with bolts 255, a grip portion 257, and a throttle lever 259 fitted to the grip portion 257. The grip portion 257 is hollow and filled with foam material 261 such as styrene foam to prevent vibration generated by the engine 1 from being transmitted to an operator who grips the handle 251.

According to this modification, the handle 251 of any shape can be fitted to the housing 3 with the bolts 255.

Figure 16:
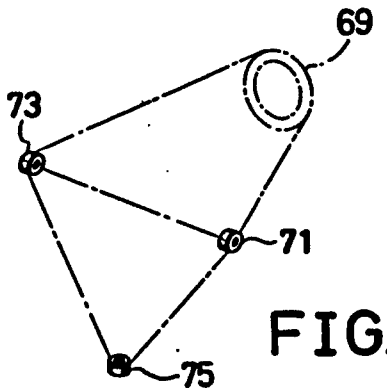
FIG. 16 is a view showing the three-dimensional positions of vibration isolators disposed according to the present invention between the housing and the engine.

FIG. 16 shows that the vibration isolators 69, 71, 73, and 75 shown in FIGS. 4 and 6 are located such that the gravity center of the reciprocate portions of engine 1, i.e., the gravity center of the piston 97 and piston rod 99, moves always within a space defined by the positions of the vibration isolators 69, 71, 73, and 75. Due to this arrangement, vibration is effectively prevented.

FIGS. 17 to 20 show the muffler 55 in detail. In the figure, a muffler case 303 comprises a body case 309 having an exhaust inlet port 307 which communicates with an exhaust port 305 of the engine 1, and a cover case 313 having an outlet port 311 which communicates with atmosphere. The body and cover cases 309 and 313 are assembled together by bending process to form the muffler case 303 having a muffler chamber 314 inside thereof. The muffler case 303 is fixed to the exhaust port 305 with bolts 315. A partition cylinder 317 having through holes 319 is provided inside the muffler case 303 to cover the exhaust inlet port 307. The cover case 313 is provided at its exhaust portion 321 with a recessed exhaust chamber 323 which is open to atmosphere, and, inside the exhaust chamber 323, a stepped portion 325. The mouth of exhaust chamber 323 is covered with a cap member 327 having an exhaust pipe 329 with a discharge mouth 311. The cap member 327 is removably fixed by a screw 333 to the stepped portion 325 of the cover case 313 with a net like spark arrestor 331 being disposed between the cap member 327 and the stepped portion 325. The spark arrestor 331 extends across the exhaust chamber 323. The exhaust chamber 323 communicates with the muffler chamber 314 through a muffling pipe 335.

According to the above arrangement, exhaust gas from the exhaust port 305 of the engine 1 enters into the partition cylinder 317 through the exhaust inlet port 307, and enters into the muffler chamber 314 through the through holes 319. After that, the exhaust gas passes through the muffling pipe 335 and the spark arrestor 331 and is discharged to atmosphere from the exhaust port 311 of the exhaust pipe 329. Fire in the exhaust gas is removed by the spark arrestor 331. Due to this constitution, the size of the spark arrestor 331 can be enlarged without enlarging the exhaust port 305 of the engine 1. Further, it is easy to clean the spark arrestor 331.

FIGS. 21 to 24 show a modification of muffler. A muffler case 411 comprises a body case 405 having an opening 403 which communicates with the exhaust port 401 of the engine 1, and a cover case 409 having an outlet port 407 which communicates with atmosphere. The muffler case 411 is fixed to the exhaust port 401 by bolts 415 through a gasket 413. A cylindrical baffle 417 having through holes 419 is held between the body case 405 and the cover case 409 to surround the opening 403. An exhaust pipe 421 passes through the cover case 409. An exhaust mouth 407 at outer end of the exhaust pipe 421 is open to atmosphere, and the inner end of exhaust pipe 421 is open in the muffler case 411 at the opening 423. A suction pipe 425 passes through the body case 405. The outer end of suction pipe 425 communicates with atmosphere, and the inner end of suction pipe 425 faces the opening 423 of the exhaust pipe 421 and is open in the muffler case 411. A duct 427 extends through the muffler case 411 from a hole 429 provided on the body case 405 and a hole 431 provided on the cover case 409.

According to the above arrangement, exhaust gas from the exhaust port 401 enters into the baffle 417, passes through the through holes 419, the inside of muffler case 411, the opening 423, and exhaust pipe 421, and is discharged from the exhaust outlet 407. The temperature of exhaust gas is decreased when the exhaust gas touches the periphery of duct 427 through which outside air flows. Further, when the exhaust gas enters into the opening 423, the dynamic pressure due to the flow of exhaust gas causes atmosphere to suck from the suction pipe 425 and mix the atmosphere with the exhaust gas to cool the exhaust gas to be discharged.

FIGS. 25 to 28 show another modification of muffler. A body case 507 is press-formed to have an exhaust inlet port 503 communicating with an exhaust port 501 of the engine 1, and an inner cylindrical portion 505 projecting inwardly. The body case 507 is fixed to the exhaust port 501 with screws 509. A cover case 513 is fitted to the body case 507 at edge portion to form the muffler case 511. The cover case 513 is press-formed to have an exhaust pipe 515 into which the inner cylindrical portion 505 of the body case 507 is inserted with a proper gap being maintained between them. The cover case 513 is divided into a first chamber 519 on the exhaust inlet port 503 side and a second chamber 521 on the exhaust pipe 515 side with recessed portions 517 which are formed by pressing the both sides of the cover case 513. Between the recessed portions 517, a passage 523 is formed. Screws 509 are positioned in the recessed portions 517.

According to the above arrangement, exhaust gas from the exhaust port 501 of the engine passes through the exhaust inlet port 503, first chamber 519, second chamber 521, and the gap formed between the exhaust pipe 515 and the inner cylindrical portion 505, and is discharged outside. When the exhaust gas passes the first and second chambers 519 and 521, the gas is expanded and contracted to reduce its noise, and it is further reduced when the gas passes through the gap between the exhaust pipe 515 and the inner cylindrical portion 505 due to the interference.

FIGS. 29 to 32 show a modification of the muffler shown in FIGS. 25 to 28. The like parts shown in Figs. 25 to 28 are represented by like numerals in FIGS. 29 to 32. The screws 509 are positioned on both sides of the exhaust port 501 of the engine and press the outer surface of cover case 513 to fix the same to the exhaust port 501. The inner end face of the inner cylindrical portion 505 is open to atmosphere. Due to this, exhaust gas jetted from the exhaust pipe 515 causes atmosphere to be sucked from the inner cylindrical portion 505 to cool the exhaust gas.

According to the above arrangement, the muffler is easily made by press-forming. Even if the cross-sectional area of exhaust pipe is small, the muffler may be made by press-forming.

Figure 33:
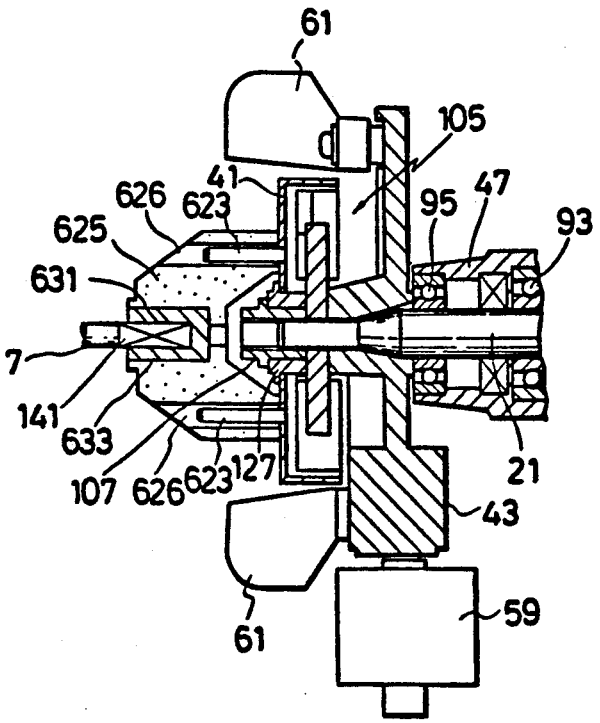
FIG. 33 is a cross-sectional view showing a modification of a vibration isolator joint which is adopted for the engine according to the present invention.

FIGS. 33 shows a modification of vibration isolator joint 39. In this modification, a plurality of fitting shafts 623 are fixed to the side face of the clutch drum 41 and extend outwardly. A vibration isolator joint 625 made of synthetic material such as rubber is provided with a plurality of fitting holes 626 which engage removably with the fitting shafts 623. At the center of vibration isolator joint 625, a fitting cylinder 633 is fixed to receive one end 141 of the transmission shaft 7. The fitting cylinder 633 may be omitted and the transmission shaft 7 may be directly inserted into a hole to be made at the center of vibration isolator joint 625.

Figure 34:
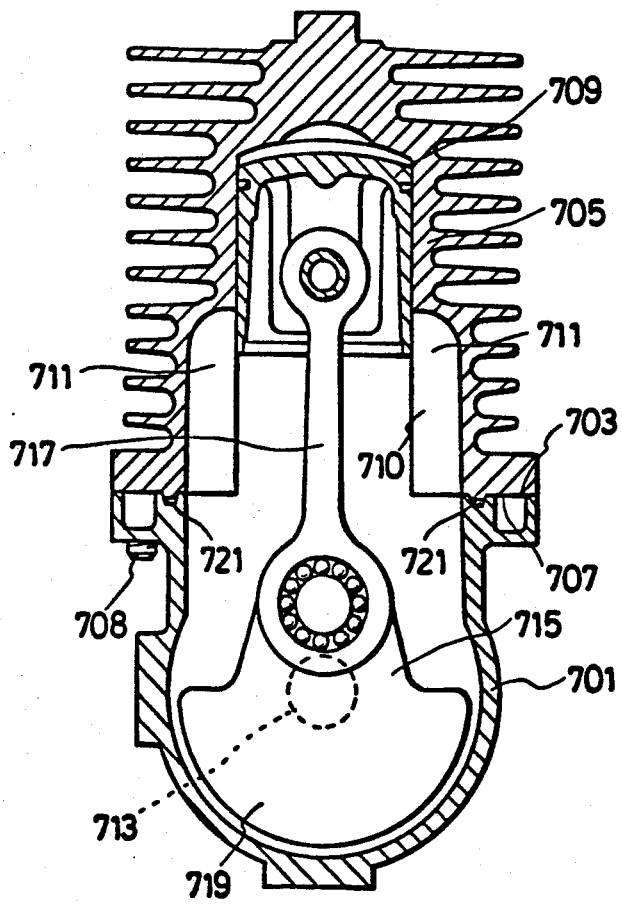
FIGS. 34 to 36 are views showing the detail of an interface between a crankcase and a cylinder of the engine according to the present invention.
Figure 35:
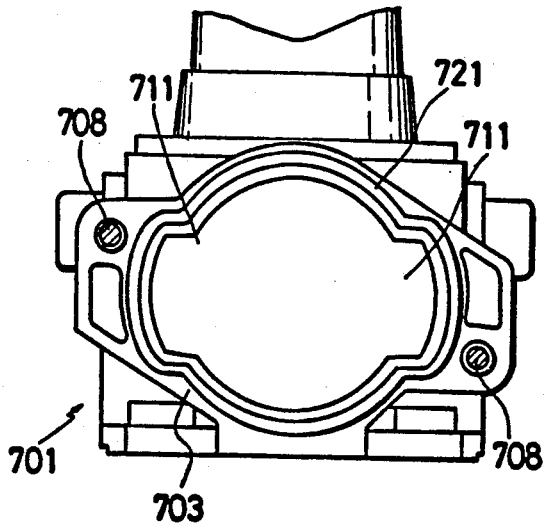
Figure 36:
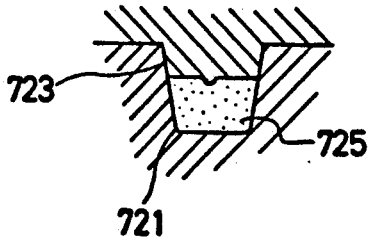

FIGS. 34 to 36 show a structure of a fitting surface between a crankcase 701 and an engine cylinder 705. In the figure, a fitting surface 703 of the crankcase 701 is fixed to a flange surface 707 of the engine cylinder 705. A seal groove 721 is provided on the fitting surface 703 along inner contour thereof, and a projection 723 which engages with the seal groove 721 is formed on the flange surface 707. In assembling, a seal member 725 such as liquid packing is filled in the seal groove 721, and the projection 723 of the flange surface 707 is engaged therewith. After that, the engine cylinder 705 and the crankcase 701 are fixed tightly with bolts 708.

According to this constitution, the flange surface 707 and the fitting surface 703 are not required to be machined so that the manufacturing process may be reduced. Further, the bolts 708 will not be loosened due to the vibration of engine, because the flange surface 707 and the fitting surface 703 contacts directly with each other without a gasket between them.

Figure 37:
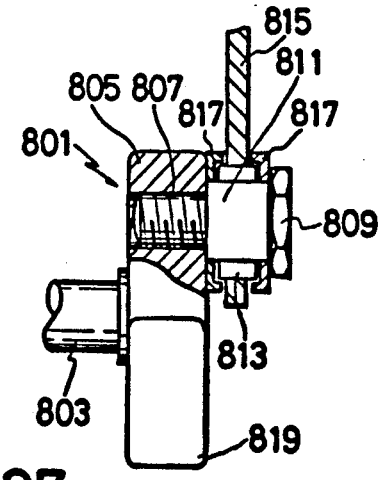
FIG. 37 is a cross-sectional side view showing the detail of a connection between a piston rod and a crank shaft of the engine according to the present invention.

FIG. 37 shows the arrangement of crank shaft. In the figure, a crank arm 805 is formed solidly at one end of a main shaft 803. The crank arm 805 is provided with a threaded hole 807 which is eccentric with respect to the main shaft 803 and extends in parallel therewith. A shoulder bolt 809 is screwed into the hole 807. One end of a piston rod 815 is connected to the stepped portion of the bolt 809 through a roller bearing 813. Washers 817 are disposed on both sides of the roller bearing 813. A balance weight 819 is formed solidly at one side of the crank arm 805 opposite to the threaded hole 807.

What is claimed is:

1. A portable engine unit comprising:

an engine including a clutch, a crank case enclosing a crank shaft, and an engine cylinder having a piston and a piston rod, a carburetor, an air filter, a recoil starter, and a muffler; and a transmission shaft rotated by said engine;

wherein said crank case and engine cylinder each have an internal bore which bores are connected when the engine cylinder is fitted to the crank case, and two exhaust ports are formed at opposite sides of the bores along the axial direction of the bores, and said crank case and said engine cylinder each have an end face, and a groove is formed on the end face of said crank case along a contour of the bore and exhaust ports, and a link-like projection which is to be engaged with said groove is formed on the end face of the engine cylinder, and sealing material is filled in said groove, whereby said crank case and said engine cylinder being fixedly attached by the engagement of said projection with said groove after said sealing material is filled in said groove.

2. A portable engine unit comprising:

an engine including a clutch, a crank case enclosing a crank shaft, and an engine cylinder having a piston and a piston rod, a carburetor, an air filter, a recoil starter, and a muffler; and a transmission shaft rotated by said engine;

wherein said crank case and engine cylinder each have an internal bore which bores are connected when the engine cylinder is fitted to the crank case, and two exhaust ports are formed at opposite sides of the bores along the axial direction of the bores, and said crank case and said engine cylinder each have an end face, and a groove is formed on the end face of said engine cylinder along a contour of the bore and exhaust ports, and a ling-like projection which is to be engaged with said groove is formed on the end face of the crank case, and sealing material is filled in said groove, whereby said crank case and said engine cylinder being fixedly attached by the engagement of said projection with said groove after said sealing material is filled in said groove.

3. A portable engine unit as claimed in claims 1 or 2, further comprising a housing for enclosing said engine.

4. A portable engine unit as claimed in claims 1 or 2, further comprising a second means for attaching said engine cylinder to said crank case.

5. A portable engine unit as claimed in claim 4, wherein said second means for attaching comprises a bolt.

6. A portable engine as claimed in claims 1 or 2 wherein the height of the ling-like projection is smaller than the depth of the groove.

* * * * *